US006974093B2

(12) United States Patent
Yamada et al.

(10) Patent No.: US 6,974,093 B2
(45) Date of Patent: Dec. 13, 2005

(54) FUEL INJECTION DEVICE

(75) Inventors: Takafumi Yamada, Susono (JP); Souichi Matsushita, Numazu (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 168 days.

(21) Appl. No.: 10/628,397

(22) Filed: Jul. 29, 2003

(65) Prior Publication Data

US 2004/0050954 A1 Mar. 18, 2004

(30) Foreign Application Priority Data

Aug. 7, 2002 (JP) ..... 2002-230029

(51) Int. Cl.[7] ..... F02M 59/00; F02M 47/02; B05B 1/30

(52) U.S. Cl. ..... 239/533.2; 239/533.12; 239/569; 239/585.5; 239/88

(58) Field of Search ..... 239/533.2, 533.3, 239/533.9, 533.12, 569, 570, 585.1–585.5, 239/88–93; 251/127, 129.15, 129.21

(56) References Cited

U.S. PATENT DOCUMENTS 4,129,254 A * 12/1978 Bader et al. ..... 239/96
4,197,996 A * 4/1980 Giardini ..... 239/87
4,219,154 A * 8/1980 Luscomb ..... 239/91
4,281,792 A * 8/1981 Sisson et al. ..... 239/5
4,410,138 A * 10/1983 Peters et al. ..... 239/95
4,427,152 A * 1/1984 Sisson et al. ..... 239/90
4,593,664 A * 6/1986 Omori et al. ..... 123/446

FOREIGN PATENT DOCUMENTS

| | | |
|---|---|---|
| DE | 41 40 070 A1 | 6/1993 |
| EP | 0 816 670 A1 | 1/1998 |
| EP | 1 126 162 A2 | 8/2001 |
| JP | A 2-223668 | 9/1990 |
| JP | A 6-173810 | 6/1994 |
| JP | A 8-128374 | 5/1996 |
| JP | A 2001-248523 | 9/2001 |
| JP | A 2001-304066 | 10/2001 |
| WO | WO 01/81752 A2 | 11/2001 |

* cited by examiner

*Primary Examiner*—Davis Hwu
(74) *Attorney, Agent, or Firm*—Oliff & Berridge, PLC

(57) ABSTRACT

A fuel injection device has an actuator, and a displacement amplification chamber for amplifying the amount of displacement of the actuator. The displacement amplification chamber is connected to a fuel passage via a replenishment fuel passage that has a check valve that allows a fuel to flow only toward the displacement amplification chamber. A throttle portion is formed in the replenishment fuel passage.

18 Claims, 3 Drawing Sheets

FUEL INJECTION DEVICE

INCORPORATION BY REFERENCE

The disclosure of Japanese Patent Application No. 2002-230029 filed on Mar. 20, 2002, including the specification, drawings and abstract is incorporated herein by reference in its entirety.

BACKGROUND OF THE INVENTION

1. Field of Invention

The invention relates to a fuel injection device.

2. Description of Related Art

A fuel injection device is used for supplying fuel to an internal combustion engine or the like, and is generally provided with a valve element that is movable in its axial direction within the body of the fuel injection device, and is operated to open and close injection holes (which will be referred to as "injection hole valve element." The injection hole valve element has a distal end portion that is provided for opening and closing injection holes, and a base portion positioned at a side opposite from the distal end portion. During a closed valve state of the injection hole valve element, the base portion receives high fuel pressure from a control chamber.

An actuator used for opening and closing the injection hole valve element does not directly open or close the injection hole valve element, but opens and closes a control valve element that is disposed within the control chamber. When the control valve element is pushed to open by the actuator, fuel flows back from the control chamber to a fuel tank or the like, thus reducing the fuel pressure in the control chamber. In this case, the fuel pressure on the base portion of the injection hole valve element drops whereas high fuel pressure continues to act on the distal end portion of the injection hole valve element. This pressure difference moves the injection hole valve element in a valve opening direction to open the injection holes, overcoming the force of a valve closing spring that urges the injection hole valve element in a valve closing direction.

When the thrust of the actuator is removed and therefore the control valve element is moved to a closed position by the spring and the like, the fuel pressure in the control chamber rises due to high-pressure fuel flowing into the control chamber. Therefore, the pressure difference between the fuel pressure acting on the distal end portion of the injection hole valve element and the fuel pressure acting on the base portion thereof becomes small so that the injection hole valve element is moved in the closing direction by the valve closing spring, and therefore closes the injection holes.

If the actuator employed in the fuel injection device is an actuator whose amount of expansion (i.e., amount of displacement) is small, such as an electrostriction actuator or the like, it is difficult for the actuator to directly open the control valve element. In a typical construction, therefore, a displacement amplification chamber is formed between a small-diameter piston that contacts the control valve element and a large-diameter piston that contacts the actuator. The amount of expansion of the actuator is amplified by the displacement amplification chamber, and the amplified displacement is exerted on the control valve element to move the control valve element to an open position.

More specifically, when the large-diameter piston is displaced by expansion of the actuator to open the control valve element, the displacement amplification chamber displaces the small-diameter piston in such a manner that the capacity of the chamber is maintained; therefore, the small-diameter piston undergoes an increased displacement. Thus, it becomes possible to reliably move the control valve element to the open position.

Generally, the displacement amplification chamber is filled with low-pressure fuel. It is ideal that a fixed capacity of the chamber be always maintained. In reality, however, as the large-diameter piston is displaced to open the control valve element, the fuel pressure in the displacement amplification chamber rises so that fuel in the displacement amplification chamber leaks out into a low-pressure fuel passageway via small gaps around the large-diameter piston and the small-diameter piston. Thus, the capacity of the displacement amplification chamber gradually decreases.

If such a reduced capacity of the displacement amplification chamber is left undealt with, a positional deviation of the small-diameter piston results, so that the control valve element cannot be reliably moved to the open position although a necessary amount of displacement of the small-diameter piston can be provided. Therefore, after the large-diameter piston is returned by contracting the actuator in order to close the control valve element, it is necessary to replenish the displacement amplification chamber with the amount of fuel lost, from the low-pressure fuel passageway.

Japanese Patent Application Laid-open No. 2001-248523 proposes a special filter disposed at an inlet of a high-pressure fuel passageway of a fuel injection device. However, this filter is not able to completely remove small extraneous particles or the like from fuel. Therefore, such extraneous particles may enter the fuel injection devices together with fuel. If such extraneous particles enter the displacement amplification chamber when the displacement amplification chamber is replenished with fuel from the low-pressure fuel passageway, the extraneous particles will impede the smooth sliding of the large-diameter piston or the small-diameter piston, resulting in the unreliable opening and closing of the control valve element.

SUMMARY OF THE INVENTION

Accordingly, an object of the invention is to provide a fuel injection device capable of maintaining the reliable opening and closing of the control valve element by preventing the entry of extraneous matter into the displacement amplification chamber.

According to a first aspect of the invention, a fuel injection device includes an actuator, and a displacement amplification chamber for amplifying an amount of displacement of the actuator. The displacement amplification chamber is connected to a low-pressure fuel passage via a replenishment fuel passage that has a check valve that allows a fuel to flow only toward the displacement amplification chamber. The replenishment fuel passage has a throttle portion.

According to a second aspect of the invention, a fuel injection device includes an actuator, and a displacement amplification chamber for amplifying an amount of displacement of the actuator. The displacement amplification chamber is connected to a low-pressure fuel passage via a replenishment fuel passage that has a check valve that allows a fuel to flow only toward the displacement amplification chamber. The replenishment fuel passage is formed so that at least a portion of the replenishment fuel passage is upward or diagonally upward when the fuel injection device is installed.

According to a third aspect of the invention, a fuel injection device includes an actuator, and a displacement amplification chamber for amplifying an amount of displacement of the actuator. The displacement amplification chamber is connected to a low-pressure fuel passage via a replenishment fuel passage that has a check valve that allows a fuel to flow only toward the displacement amplification chamber. The replenishment fuel passage has a fuel stagnation space.

In a preferred form of the fuel injection device according to the first aspect of the invention, the throttle portion of the replenishment fuel passage may be formed so as to be upward or diagonally upward when the fuel injection device is installed.

In a further preferred form, a fuel stagnation space may be formed at an immediately upstream side of the throttle portion of the replenishment fuel passage.

In a preferred form of any one of the fuel injection devices constructed as described above, a large-diameter piston that is displaceable by the actuator may face a small-diameter piston via the displacement amplification chamber, and the replenishment fuel passage may extend from a peripheral portion of the large-diameter piston which is located at a side relatively close to the actuator, to the displacement amplification chamber, via an interior of the large-diameter piston.

In a preferred form of any one of the fuel injection devices constructed as described above, the interior of the large-diameter piston comprises a dead-end hole that is formed as a portion of the replenishment fuel passage along an axial center of the large-diameter piston, the dead end hole being closed at an upper potion and opened at lower portion so as to be connected in communication to the displacement amplification chamber.

In a preferred form of any one of the fuel injection devices constructed as described above, the check valve is configured such that the interior of the large-diameter piston is placed in communication to or shut off from the displacement amplification chamber by operating the check valve.

In a preferred form of any one of the fuel injection devices constructed as described above, a sectional area of the peripheral portion of the large-diameter piston located close to the actuator is smaller than a sectional area of another peripheral portion of the large-diameter piston located close to the small-diameter piston, and the fuel stagnation space is formed between the peripheral portion of the large-diameter piston located close to the actuator and a body of the fuel injection device.

In a preferred form of any one of the fuel injection devices constructed as described above, the throttle portion is formed so as to extend vertically upward or at a predetermined angle from the fuel stagnation space towards the interior of the large-diameter piston.

BRIEF DESCRIPTION OF THE DRAWINGS

The foregoing and/or further objects, features and advantages of the invention will become more apparent from the following description of preferred embodiments with reference to the accompanying drawings, in which like numerals are used to represent like elements and wherein.

DETAILED DESCRIPTION OF PREFERRED EMBODIMENTS

Figure 1:
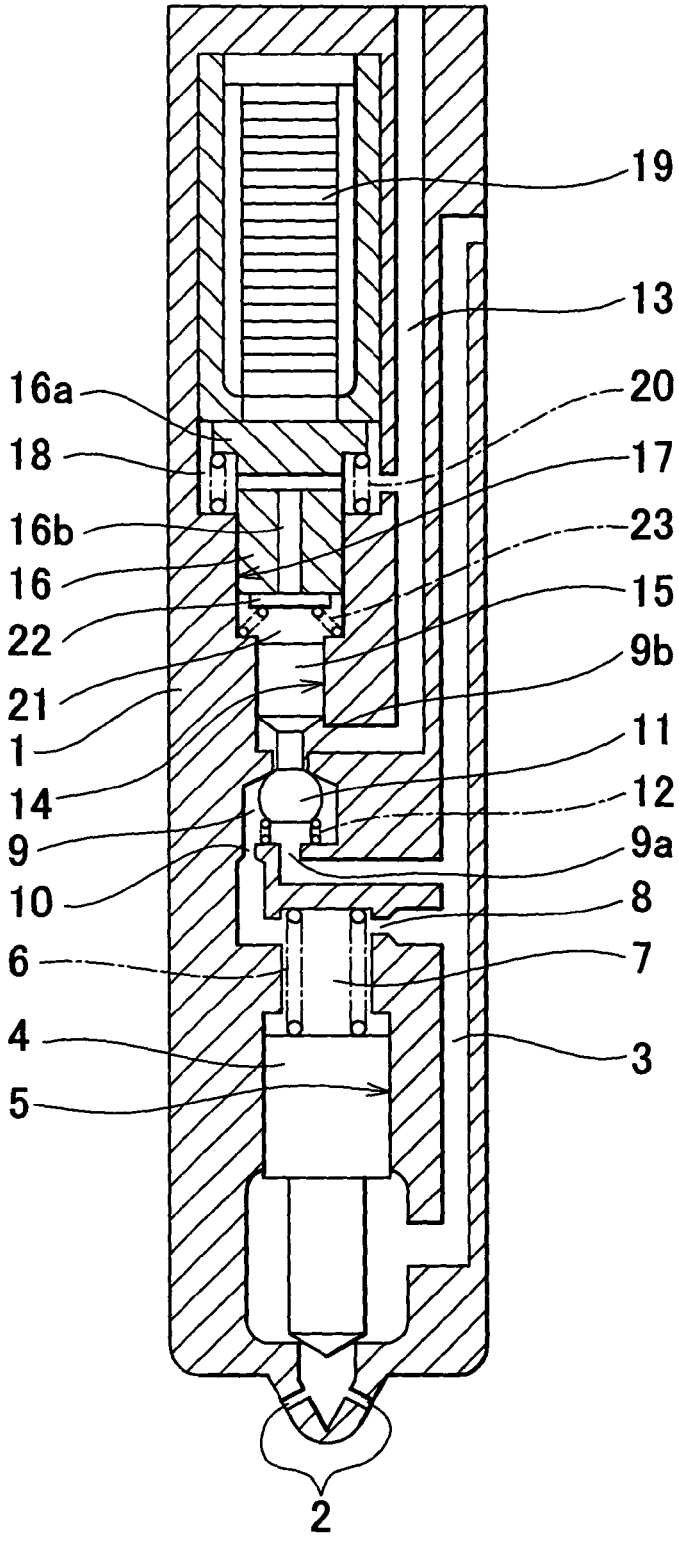
FIG. 1 is a schematic longitudinal section of an ordinary fuel injection device, illustrating a state where fuel injection is stopped.
Figure 2:
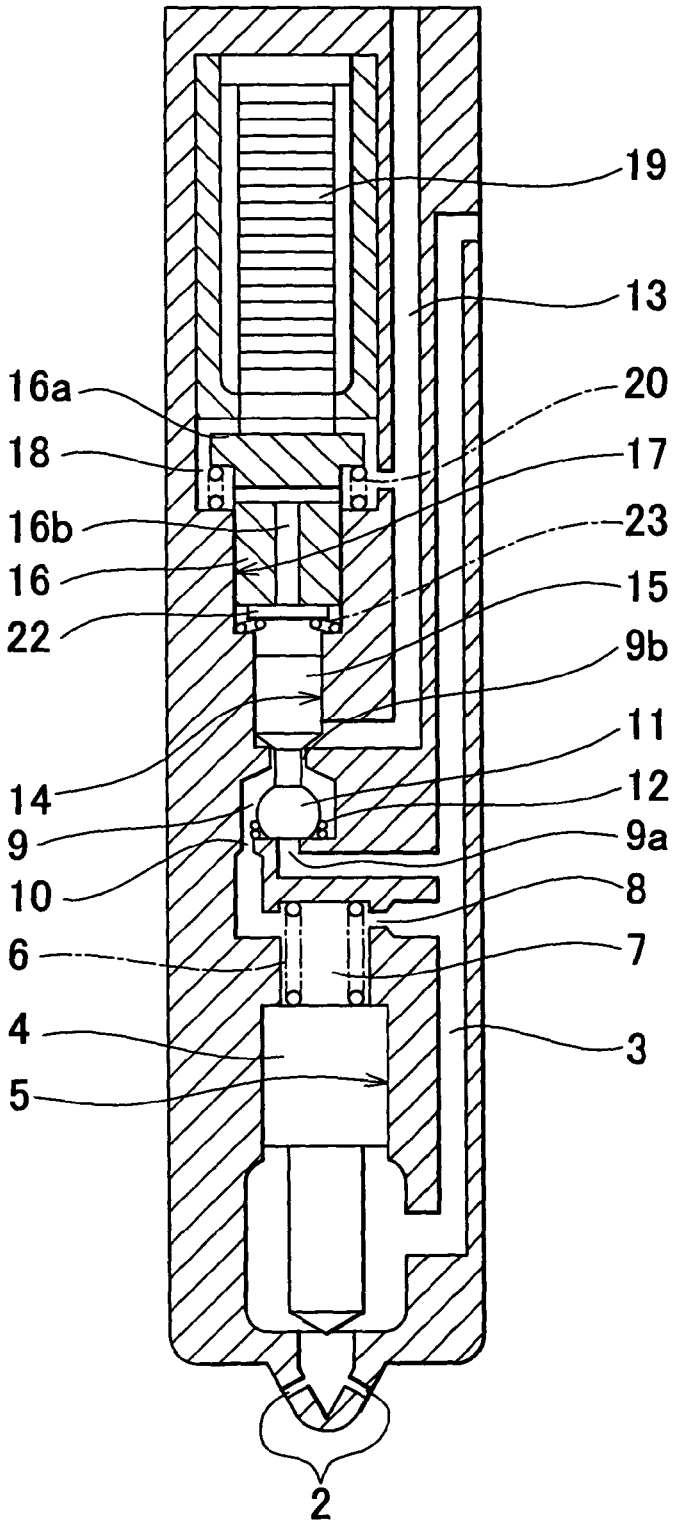
FIG. 2 is a schematic longitudinal section of the fuel injection device shown in FIG. 1, illustrating a state where fuel injection is performed.

FIGS. 1 and 2 are sectional views of an ordinary fuel injection device. Such a fuel injection device, including the fuel injection device of the invention, injects high-pressure fuel pressurized in a common pressure accumulator chamber directly into the individual cylinders of, for example, a diesel engine or a direct injection type spark-ignition engine. The fuel injection device may also be used to inject fuel into portions other than the cylinder interiors, for example, into intake ports.

Referring to FIGS. 1 and 2, a fuel injection device body 1 has, at its distal end, injection holes 2. A high-pressure fuel passageway 3 is connected at an end portion thereof to the injection holes 2. At another end portion, the high-pressure fuel passageway 3 is supplied with high-pressure fuel from a pressure accumulator chamber or the like. A sliding hole 5 is formed for the sliding movements of an injection hole valve element 4 for opening and closing the injection holes 2. A distal end portion of the injection hole valve element 4 is able to close the high-pressure fuel passageway 3 at a side upstream of the injection holes 2. A control chamber 7 contains a valve closing spring 6 that urges the injection hole valve element 4 in a valve closing direction.

The control chamber 7 is connected in communication to the high-pressure fuel passageway 3 via an orifice 8. Therefore, the injection hole valve element 4 receives a pushing force in the valve closing direction from the high pressure fuel supplied into the control chamber 7. The injection hole valve element 4 also receives a pushing force in the valve opening direction from the high-pressure fuel supplied via the high-pressure fuel passageway 3 extending to the injection holes 2. When the injection holes 2 are closed as indicated in FIG. 1, the closing-direction pushing force exerted on the injection hole valve element 4 by the high-pressure fuel is greater than the opening-direction pushing force on the injection hole valve element 4 by the high-pressure fuel because the pressure receiving area on a base end side of the injection hole valve element 4 in the control chamber 7 is larger than the pressure receiving area (effective in producing the pushing force) on a distal end side of the injection hole valve element 4 in the high-pressure fuel passageway 3.

A low-pressure fuel passageway 13 is connected to the fuel tank (not shown) and the like. A valve chamber 9 is directly connected in communication to the high-pressure fuel passageway 3 via a high pressure side opening 9*a,* and is also connected in communication to the control chamber 7 via an orifice 10. Furthermore, the valve chamber 9 is connected in communication to the low-pressure fuel passageway 13 via a low pressure side opening 9*b.* Disposed within the valve chamber 9 are a control valve element 11 for closing the low pressure side opening 9*b,* and a push spring 12 for pushing the control valve element 11 in a closing direction.

A sliding hole 14 is formed for the sliding movements of a small-diameter piston 15 that is provided for moving the control valve element 11 to an open position. The sliding hole 14 is connected in communication to a sliding hole 17 that is formed for a large-diameter piston 16. The sliding hole 17 for the large-diameter piston 16 is connected in communication to a further increased-diameter space 18 in which a flange portion 16*a* of the large-diameter piston 16 is positioned. An electrostriction actuator 19 abuts against the flange portion 16*a* of the large-diameter piston 16. A return spring 20 is disposed between the flange portion 16*a* of the large-diameter piston 16 and a step wall portion formed at a boundary between the sliding hole 17 for the large-diameter piston 16 and the space 18. Therefore, the large-diameter piston 16 remains in a pressing contact with the electrostriction actuator 19 even when the electrostriction actuator 19 contracts.

In the state illustrated in FIG. 1, the closing-direction pushing force exerted on the injection hole valve element 4 by high-pressure fuel is greater than the opening-direction pushing force on the injection hole valve element 4 by high-pressure fuel as stated above. Therefore, due to the closing-direction pushing force caused by fuel pressure and the closing-direction pushing force applied by the valve-closing spring 6, the injection hole valve element 4 is held at a closed position, closing the injection holes 2.

To open the injection holes 2 so as to start injecting fuel, a voltage is applied to the electrostriction actuator 19 to expand the electrostriction actuator 19 and therefore push the large-diameter piston 16 as indicated in FIG. 2. Therefore, the large-diameter piston 16 is displaced along the sliding hole 17 toward the small-diameter piston 15. A displacement amplification chamber 21 filled with low-pressure fuel is provided between the large-diameter piston 16 and the small-diameter piston 15, and is partially defined by a step wall portion at a boundary between the sliding hole 17 for the large-diameter piston 16 and the sliding hole 14 for the small-diameter piston 15. Therefore, as the large-diameter piston 16 is displaced, the small-diameter piston 15 is displaced along the sliding hole 14 so that the capacity of the displacement amplification chamber 21 is maintained. More specifically, the amount of displacement of the small-diameter piston 15 becomes greater than the amount of displacement of the large-diameter piston 16, that is, the amount of expansion of the electrostriction actuator 19.

Hence, the small-diameter piston 15 reliably moves the control valve element 11 to an open position against the force of the push spring 12, so that the control valve element 11 opens the low pressure side opening 9*b* of the valve chamber 9 and closes the high pressure side opening 9*a*. Therefore, high-pressure fuel in the valve chamber 9 returns toward the fuel tank and the like via the low-pressure fuel passageway 18, so that the fuel pressure in the control chamber 7 connected to the valve chamber 9 rapidly falls. As the fuel pressure in the control chamber 7 falls, the closing-direction force exerted on the injection hole valve element 4 by the fuel pressure decreases. As a result, the closing-direction force on the injection hole valve element 4 combined with the force of the valve-closing spring 6 becomes less than the opening-direction force exerted on the injection hole valve element 4 by the fuel pressure in the high-pressure fuel passageway 3. Therefore, the injection hole valve element 4 is moved to an open position, opening the injection holes 2. During the open valve state of the injection hole valve element 4, the closure of the high pressure side opening 9*a* of the valve chamber 9 by the control valve element 11 prevents direct outflow of fuel from the high-pressure fuel passageway 3 into the low-pressure fuel passageway 13 via the valve chamber 9. Therefore, consumption of fuel in the high-pressure fuel passageway 3 is minimized.

To close the injection holes 2 so as to stop the fuel injection, the application of voltage to the electrostriction actuator 19 is discontinued, so that the expanded electrostriction actuator 19 contracts. As the pushing force from the electrostriction actuator 19 to the large-diameter piston 16 disappears, the large-diameter piston 16 is returned to the original position while being held in contact with the electrostriction actuator 19, due to the force of the return spring 20 acting on the flange portion 16*a* of the large-diameter piston 16. During this operation, too, the capacity of the displacement amplification chamber 21 is maintained, so that the small-diameter piston 15 is returned to a position indicated in FIG. 1. As the pushing force exerted on the control valve element 11 by the small-diameter piston 15 disappears, the control valve element 11 is moved back to the closed position, closing the low pressure side opening 9*b* of the valve chamber 9 and opening the high pressure side opening 9*a,* due to the push spring 12. The valve chamber 9 is immediately filled with high-pressure fuel supplied from the high-pressure fuel passageway 3 via the high pressure side opening 9*a*.

High-pressure fuel in the valve chamber 9 is supplied into the control chamber 7 via the orifice 10. High-pressure fuel is also supplied into the control chamber 7 from the high-pressure fuel passageway 3 via the orifice 8. Thus, the control chamber 7 is relatively soon filled with high-pressure fuel. Thus, the sum of the closing-direction force exerted on the injection hole valve element 4 by high-pressure fuel via the control chamber 7 and the force of the valve-closing spring becomes greater than the opening-direction force exerted on the injection hole valve element 4 by high-pressure fuel via the high-pressure fuel passageway 3, so that the injection hole valve element 4 is moved to the closed position.

As described above, although the amount of displacement of the electrostriction actuator 19, that is, the amount of expansion thereof, is relatively small, the provision of the displacement amplification chamber 21 between the large-diameter piston 16 and the small-diameter piston 15 makes it possible to reliably open the control valve element 11. It is ideal that a fixed capacity of the displacement amplification chamber 21 be maintained, as mentioned above. However, in reality, as the large-diameter piston 16 is displaced to displace the small-diameter piston 15 so as to open the control valve element 11, the fuel pressure in the displacement amplification chamber 21 rises so that a portion of the fuel in the displacement amplification chamber 21 leaks out into the low-pressure fuel passageway 13 via a small gap around the small-diameter piston 15.

If fuel leakage occurs in this manner, the reduced capacity of the displacement amplification chamber 21 results in a positional deviation of the small-diameter piston 15 when the small-diameter piston 15 is returned by returning the large-diameter piston 16 to the original position in order to close the control valve element 11. This raises the possibility that the small-diameter piston 15 will fail to sufficiently open the control valve element 11. In order to prevent such positional deviation of the small-diameter piston 15, it is necessary that the amount of fuel lost from the displacement amplification chamber 21 be supplied from the low-pressure fuel passageway 13 into the displacement amplification chamber 21, when the small-diameter piston 15 is returned to the original position.

In an ordinary fuel injection device as shown in FIGS. 1 and 2, the space 18 in which the return spring 20 is disposed is connected in communication to the low-pressure fuel passageway 13, and a replenishment fuel passageway 16*b* extends within the large-diameter piston 16. The replenishment fuel passageway 16*b* communicates with the space 18, and has an opening to the displacement amplification chamber 21. An opening portion of the replenishment fuel passageway 16*b* to the displacement amplification chamber 21 is provided with a check valve that allows fuel to flow only toward the displacement amplification chamber 21. This check valve in the fuel injection device shown in FIGS. 1 and 2 is made up of a platy member 22 capable of closing the opening portion, and a spring 23 that urges the platy member 22 in the closing direction from the side of the displacement amplification chamber 21.

In the case where the large-diameter 16 is returned by contracting the electrostriction actuator 19 after a fuel leak from the displacement amplification chamber 21 has occurred, the fuel pressure in the displacement amplification chamber 21 will become lower than the fuel pressure in the low-pressure fuel passageway 13 when the small-diameter piston 15 is returned while remaining in contact with the control valve element 11 positioned at the closed position. Therefore, the platy member 22 as a check valve element opens the opening portion of the replenishment fuel passageway 16*b,* so that the displacement amplification chamber 21 is replenished with low-pressure fuel from the low-pressure fuel passageway 13.

Incidentally, the high-pressure fuel supplied into the high-pressure fuel passageway 3 of a fuel injection valve device from a pressure accumulator chamber or the like often contains small extraneous particles or the like. Such small extraneous particles cannot be completely removed even if a filter or the like is disposed in the high-pressure fuel passageway 3. Therefore, the low-pressure fuel in the low-pressure fuel passageway 13 may possibly contain small extraneous particles or the like, and the construction of the replenishment fuel passageway 16*b* of the fuel injection device shown in FIGS. 1 and 2 may allow small extraneous particles to enter the displacement amplification chamber 21 together with replenishment fuel. Small extraneous particles in the displacement amplification chamber 21 will impede the smooth sliding of the large-diameter piston 16 or the small-diameter piston 15, resulting in the unreliable opening and closing of the control valve element 11.

Figure 3:
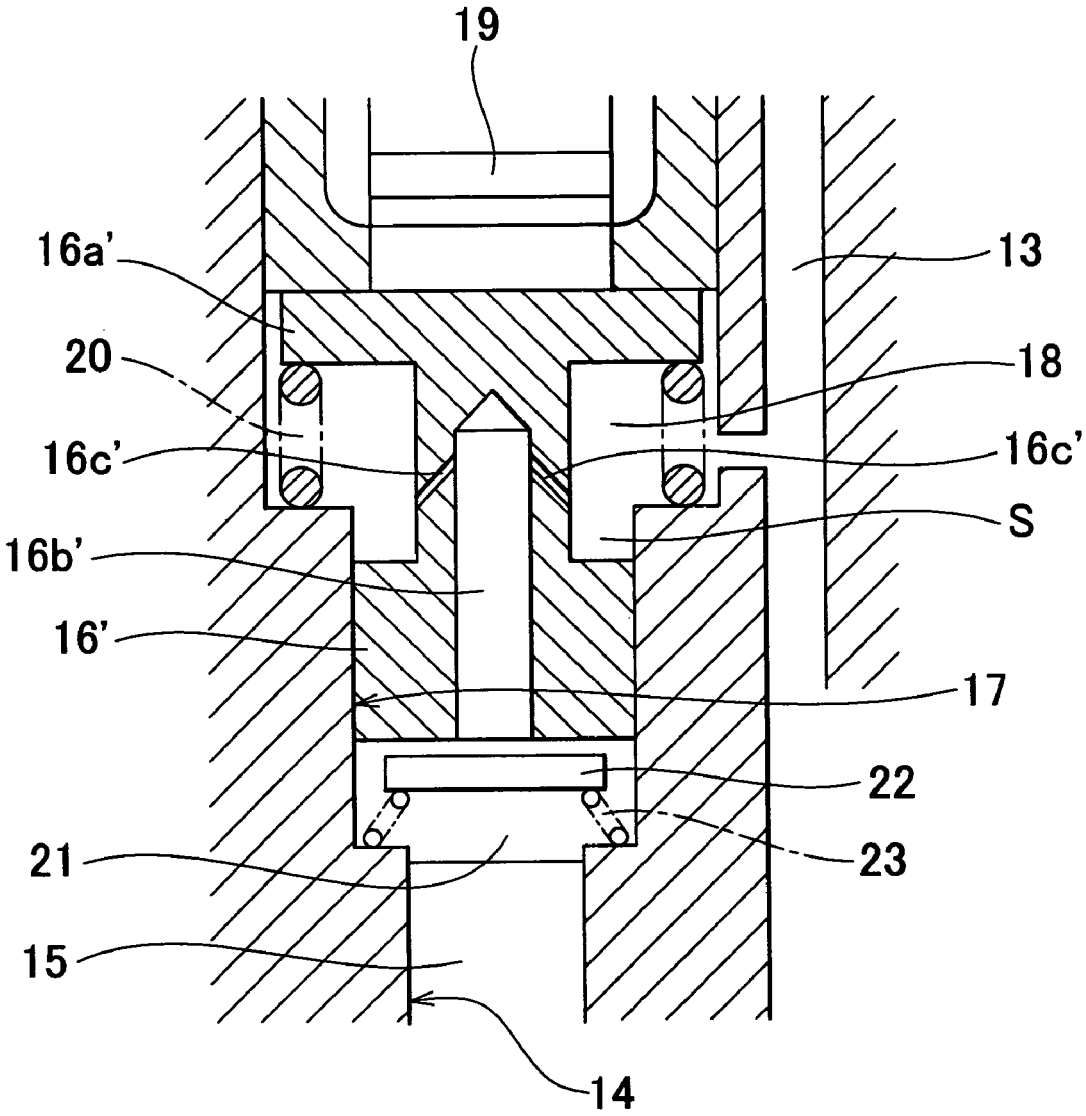
FIG. 3 is an enlarged sectional view of a displacement amplification chamber with its surrounding portions in a fuel injection device according to the invention.

The fuel injection device according to an embodiment of the invention is intended to reliably prevent entry of such small extraneous matter into the displacement amplification chamber. A construction for that purpose is illustrated in an enlarged view of the displacement amplification chamber 21 and its surrounding portions in FIG. 3. Portions not shown in FIG. 3 are substantially the same as those of the ordinary fuel injection device shown in FIGS. 1 and 2. Components and portions comparable to those shown in FIGS. 1 and 2 are represented by comparable reference characters in FIG. 3, and will not be described in detail below. Differences of the fuel injection device shown in FIG. 3 from the fuel injection device shown in FIGS. 1 and 2 will mainly be described below.

Similar to the above-described large-diameter piston 16, a large-diameter piston 16' of the fuel injection device according to the embodiment has a flange portion 16*a*' for supporting a return spring 20. A first peripheral portion of the large-diameter piston 16' adjacent to the flange portion 16*a*', that is, relatively close to an electrostriction actuator 19, is narrower in diameter than a second peripheral portion of the large-diameter piston 16' located at a side remote from the electrostriction actuator 19. The second peripheral portion is provided with the large diameter of the large-diameter piston, and slides along the wall of a sliding hole 17. A central portion of the large-diameter piston 16' around an axis thereof has a dead-end hole that has an opening to a displacement amplification chamber 21 and that forms a portion of a replenishment fuel passageway. Orifices 16*c*' extend from the first peripheral portion to the dead-end hole 16*b*', forming another portion of the replenishment fuel passageway. Thus, via the dead-end hole 16*b*' and the orifices 16*c*', the displacement amplification chamber 21 is connected to a space 18 that communicates with a low-pressure fuel passageway 13. An opening portion of the replenishment fuel passageway to the displacement amplification chamber 21 is closed by a check valve that is formed by a platy member 22 and a spring 23 similarly to the above-described check valve.

In this fuel injection device, since the replenishment fuel passageway is provided with the orifices 16*c*' serving as a throttle portion, fuel in the space 18 flows into the replenishment fuel passageway (16*b*') through the orifices 16*c*' at very high velocity. Generally, the small extraneous matter in fuel is metal particles or the like that have a greater specific gravity than the fuel. Therefore, if small extraneous particles are contained in the low-pressure fuel that flows into the space 18 from the low-pressure passageway 13, the small extraneous particles exist in a low-velocity region or a stagnation region S in the space 18, and do not exist in a high-velocity region. Thus, the high-velocity currents of fuel entering the orifices 16*c*' do not contain small extraneous particles or the like, and therefore extraneous particles do not enter the displacement amplification chamber 21.

In the embodiment, the orifices 16*c*', forming a portion of the replenishment fuel passageway, extend diagonally upward toward the dead-end hole 16*b*' as indicated in FIG. 3 when the fuel injection device is mounted on an internal combustion engine. Therefore, extraneous particles of high specific gravity do not ascend through the orifices 16*c*' against gravity, and therefore do not enter the displacement amplification chamber 21. The fuel injection device of the embodiment is mounted to an engine in a posture as indicated in FIG. 3, that is, in a posture such that the direction of the axis of the device coincides with the vertical direction. However, in a case where the fuel injection device is mounted so that the direction of the axis of the device is diagonal to the vertical direction, at least one of the orifices 16*c*' may possibly extend perfectly in the vertical direction. Although in the fuel injection device of the embodiment, the orifices 16*c*' as a portion of the replenishment fuel passageway are formed upward or diagonally upward in order to prevent the entry of extraneous particles of relatively high specific gravity into the displacement amplification chamber 21, the entry of such extraneous matter can also be prevented by a construction in which a portion of the replenishment fuel passageway without an orifice is formed so as to extend upward or diagonally upward.

In the fuel injection device, the region S in the space 18 located at an immediately upstream side of the orifices 16*c*' is a fuel stagnation region where no current occurs. Extraneous particles, having high specific gravity, are likely to congregate and reside in the fuel stagnation region S. Therefore, the extraneous particles that enter the space 18 do not enter the displacement amplification chamber 21 via the replenishment fuel passageway.

In the fuel injection device of this embodiment, the fuel stagnation space S is provided at an immediately upstream side of the orifices 16*c*' extending upward or diagonally upward. This arrangement very effectively prevents entry of extraneous matter into the displacement amplification chamber 21. However, the space 18 can be considered to be a portion of the replenishment fuel passageway. Therefore, if in a construction of a replenishment fuel passageway without an orifice, a fuel stagnation space is formed in a portion of the replenishment fuel passageway which extends within a large-diameter piston, extraneous matter will reside in the fuel stagnation space, so that the entry of extraneous matter into the displacement amplification chamber 21 can be sufficiently prevented.

Although in the fuel injection device of the foregoing embodiment, a major portion of the replenishment fuel passageway is formed in the large-diameter piston 16' as in the conventional device, this construction does not restrict the invention. For example, the replenishment fuel passageway may extend from a low-pressure fuel passageway directly to the displacement amplification chamber 21.

In a fuel injection device according to an embodiment of the invention, a displacement amplification chamber is connected in communication to a fuel passageway via a replenishment fuel passageway provided with a check valve that allows fuel to flow only toward the displacement amplification chamber, and the replenishment fuel passageway has a throttle portion. Therefore, fuel flows into the throttle portion of the replenishment fuel passageway at high velocity. Hence, extraneous particles having higher specific gravity than the fuel are more likely to reside in a low-velocity region or a stagnation region than in a high-velocity region, at a side immediately upstream of the throttle portion. Therefore, such extraneous particles will not enter a space downstream of the throttle portion. In this manner, the entry of extraneous matter into the displacement amplification chamber is prevented, so that the reliable opening and closing of the control valve element can be maintained.

In a fuel injection device according to another embodiment of the invention, a displacement amplification chamber is connected in communication to a fuel passageway via a replenishment fuel passageway provided with a check valve that allows fuel to flow only toward the displacement amplification chamber, and the replenishment fuel passageway is formed so that at least a portion of the passageway extends upward or diagonally upward when the fuel injection device is installed. Therefore, extraneous particles having higher specific gravity than the fuel are unlikely to pass through the upward or diagonally upward portion of the replenishment fuel passageway, and therefore do not enter a portion of the passageway downstream of the upward or diagonally upward portion. In this manner, the fuel injection device of this embodiment also achieves the advantages of preventing the entry of extraneous matter into the displacement amplification chamber and therefore maintaining the reliable opening and closing of the control valve element.

In a fuel injection device according to still another embodiment of the invention, a displacement amplification chamber is connected in communication to a fuel passageway via a replenishment fuel passageway provided with a check valve that allows fuel to flow only toward the displacement amplification chamber, and the replenishment fuel passageway has a fuel stagnation space. Therefore, extraneous particles having higher specific gravity than the fuel are likely to congregate and reside in the fuel stagnation space, and therefore do not enter a portion of the passageway downstream of the fuel stagnation space. Thus, this embodiment also prevents the entry of extraneous matter into the displacement amplification chamber and therefore allows maintenance of the reliable opening and closing of the control valve element.

What is claimed is:

1. A fuel injection device, comprising:

an actuator;

a displacement amplification chamber that amplifies an amount of displacement of the actuator;

a low pressure fuel passage; and a replenishment fuel passage that places the low pressure fuel passage and the displacement amplification chamber in communication and has a check valve which allows a fuel to flow only toward the displacement amplification chamber, wherein the replenishment fuel passage has an extraneous matter separator that separates extraneous matter having a greater specific gravity than fuel, the extraneous matter separator being provided upstream of the check valve.

2. The fuel injection device according to claim 1, wherein the extraneous matter separator includes a throttle portion that is formed upstream of the check valve in the replenishment fuel passage.

3. The fuel injection device according to claim 2, wherein the throttle portion of the replenishment fuel passage is formed so as to extend vertically upward or at a predetermined angle when the fuel injection device is installed.

4. The fuel injection device according to claim 1, wherein a fuel stagnation space is formed at an immediately upstream side of the throttle portion of the replenishment fuel passage.

5. The fuel injection device according to claim 2, wherein a large-diameter piston that is displaceable by the actuator and a small-diameter piston that faces the large-diameter piston via the displacement amplification chamber are provide, and at least one piston of the replenishment fuel passage extends from a peripheral portion of the large-diameter piston which is located at a side relatively close to the actuator, to the displacement amplification chamber, via an interior of the large-diameter piston.

6. The fuel injection device according to claim 5, wherein the interior of the large-diameter piston comprises a dead-end hole that is formed as a portion of the replenishment fuel passage along an axial center of the large-diameter piston, the dead end hole being closed at an upper potion and opened at lower portion so as to be connected in communication to the displacement amplification chamber.

7. The fuel injection device according to claim 5, wherein the check valve is configured such that the interior of the large-diameter piston is placed in communication to or shut off from the displacement amplification chamber by operating the check valve.

8. The fuel injection device according to claim 5, wherein a sectional area of the peripheral portion of the large-diameter piston located close to the actuator is smaller than a sectional area of another peripheral portion of the large-diameter piston located close to the small-diameter piston; and a fuel stagnation space is formed between the peripheral portion of the large-diameter piston located close to the actuator and a body of the fuel injection device.

9. The fuel injection device according to claim 5, wherein the throttle portion is formed so as to extend vertically upward or at a predetermined angle from the fuel stagnation space towards the interior of the large-diameter piston.

10. The fuel injection device, according to claim 1, wherein the extraneous matter separator includes a portion of the replenishment fuel passage that is formed upstream of the check valve so as to extend at least one of vertically upward or at a predetermined angle when the fuel injection device is installed.

11. The fuel injection device according to claim 10, wherein a large-diameter piston that is displacement by the actuator and a small-diameter piston that faces the large-diameter piston via the displacement amplification chamber are provided, and at least one portion of the replenishment fuel passage extends from a peripheral portion of the large-diameter piston which is located at a side relatively close to the actuator, to the displacement amplification chamber, via an interior of the large-diameter piston.

12. The fuel injection device according to claim 11, wherein the interior of the large-diameter piston comprises a dead-end hole that is formed as a portion of the replenishment fuel passage along an axial center of the large-diameter piston, the dead end hole being located at an upper potion and opened at lower portion so as to be connected in communication to the displacement amplification chamber.

13. The fuel injection device according to claim 11, wherein the check valve is configured such that the interior of the large-diameter piston is placed in communication to or shut off from the displacement amplification chamber by operating the check valve.

14. The fuel injection device, according to claim 1, wherein the extraneous matter separator includes a fuel stagnation space that is formed upstream of check valve in the replenishment fuel passage.

15. The fuel injection device according to claim 14, wherein a large-diameter piston that is displaceable by the actuator an a small-diameter piston that faces the large-diameter piston via the displacement amplification chamber are provided, and at least one portion of the replenishment fuel passage extends from a peripheral portion of the large-diameter piston which is located at a side relatively close to the actuator, to the displacement amplification chamber, via an interior of the large-diameter piston.

16. The fuel injection device according to claim 15, wherein the interior of the large-diameter piston comprises a dead-end hole that is formed as a portion of the replenishment fuel passage along an axial center of the large-diameter piston, the dead end hole being closed at an upper portion and opened at lower portion so as to be connected in communication to the displacement amplification chamber.

17. The fuel injection device according to claim 15, wherein the check valve is configured such that the interior of the large-diameter piston is placed in communication to or shut off from the displacement amplification chamber by operating the check valve.

18. The fuel injection device according to claim 15, wherein a sectional area of the peripheral portion of the large-diameter piston located close to the actuator is smaller than a sectional area of another peripheral portion of the large-diameter piston located close to the small-diameter piston; and the fuel stagnation space is formed between the peripheral portion of the large-diameter piston located close to the actuator and a body of the injection device.

* * * * *